US009682395B2

(12) United States Patent
Park et al.

(10) Patent No.: US 9,682,395 B2
(45) Date of Patent: Jun. 20, 2017

(54) SLOT DIE COATING APPARATUS

(71) Applicant: LG CHEM, LTD., Seoul (KR)

(72) Inventors: Won Chan Park, Daejeon (KR); Jung Hyun Yeo, Daejeon (KR); Ye Hoon Im, Daejeon (KR)

(73) Assignee: LG CHEM, LTD., Seoul (KR)

( * ) Notice: Subject to any disclaimer, the term of this patent is extended or adjusted under 35 U.S.C. 154(b) by 73 days.

(21) Appl. No.: 14/432,106

(22) PCT Filed: Feb. 28, 2014

(86) PCT No.: PCT/KR2014/001693
§ 371 (c)(1),
(2) Date: Mar. 27, 2015

(87) PCT Pub. No.: WO2014/133364
PCT Pub. Date: Sep. 4, 2014

(65) Prior Publication Data

US 2015/0273514 A1 Oct. 1, 2015

(30) Foreign Application Priority Data

Feb. 28, 2013 (KR) ..... 10-2013-0022223

(51) Int. Cl.

| | |
|---|---|
| ***B05C 9/10*** | (2006.01) |
| ***B05C 11/02*** | (2006.01) |
| *B05C 5/00* | (2006.01) |
| *B05C 5/02* | (2006.01) |
| *B05C 11/10* | (2006.01) |

(52) U.S. Cl.
CPC ..... *B05C 9/10* (2013.01); *B05C 11/02* (2013.01); *B05C 5/005* (2013.01); *B05C 5/008* (2013.01); *B05C 5/0245* (2013.01); *B05C 5/0254* (2013.01); *B05C 11/10* (2013.01)

(58) Field of Classification Search
CPC ..... B05C 9/10; B05C 5/0254; B05C 11/02; B05C 5/0245; B05C 11/10; B05C 5/005; B05C 5/008
USPC ..... 118/410–412, 419
See application file for complete search history.

(56) References Cited

U.S. PATENT DOCUMENTS

2006/0068114 A1* 3/2006 Hasegawa ..... B05C 5/0254 427/356

FOREIGN PATENT DOCUMENTS

| | | | |
|---|---|---|---|
| CN | 102343321 | A | 2/2012 |
| JP | 05004064 | A | 1/1993 |
| JP | 08010678 | A | 1/1996 |
| JP | 2767712 | B2 | 4/1998 |
| JP | 2000-290388 | A | 10/2000 |
| JP | 2002-361146 | A | 12/2002 |
| JP | 2003-181857 | A | 7/2003 |

(Continued)

*Primary Examiner* — Laura Edwards
(74) *Attorney, Agent, or Firm* — Dentons US LLP

(57) ABSTRACT

The present application relates to a slot die coating apparatus and, more particularly, to a slot die coating apparatus which can ensure the coating stability of a substrate film by reducing pressure oscillations within a vacuum chamber when slot die coating is carried out. The slot die coating apparatus according to the present application can effectively dampen pressure oscillations within a vacuum chamber by connecting a pressure oscillation reducing tank to the vacuum chamber and thus can ensure the coating stability of a substrate film, resulting in a reduction in the proportion of defective products.

5 Claims, 2 Drawing Sheets

(56) References Cited

FOREIGN PATENT DOCUMENTS

| | | | | |
|---|---|---|---|---|
| JP | 2003-251260 | A | | 9/2003 |
| JP | 2006095456 | A | | 4/2006 |
| JP | 2006-341177 | A | | 12/2006 |
| JP | 3856114 | B2 | | 12/2006 |
| JP | 2007268383 | A | | 10/2007 |
| JP | 2008000714 | A | | 1/2008 |
| JP | 2009-241013 | A | | 10/2009 |
| KR | 1020110098578 | A | | 9/2011 |
| KR | 1020120108484 | A | | 10/2012 |
| WO | WO91/14969 | | * | 10/1991 |

* cited by examiner

SLOT DIE COATING APPARATUS

This application is a National Stage Application of International Application No. PCT/KR2014/001693, filed Feb. 28, 2014, and claims the benefit of Korean Patent Application No. 10-2013-0022223, filed on Feb. 28, 2013, all of which are hereby incorporated by reference in their entirety for all purposes as if fully set forth herein.

TECHNICAL FIELD

The present application relates to a slot die coating apparatus, and more particularly, to a slot die coating apparatus which can ensure the coating stability of a base film by reducing pressure oscillations within a vacuum chamber when slot die coating is carried out.

BACKGROUND ART

Generally, as a method of forming a coating layer on a base film, slot die coating methods have been used.

FIG. 1 is a configuration diagram schematically illustrating a conventional slot die coating used in the slot die coating method.

As shown in FIG. 1, coating is carried out on the surface of a substrate film 2 wound around a roll 1 using a slot die 3. A coating layer 4 is formed on the surface of the base film 2 by the slot die 3. In this case, a vacuum chamber 5 is attached at a front end of the slot die 3, and the vacuum chamber 5 serves to increase the stability of the coating by creating a vacuum environment locally.

However, since the vacuum chamber 5 does not come in close contact with the base film 2 in order to form the coating layer, a certain gap D should be made. Due to the flow of the air inflow through the gap D, high velocity flow occurs in the vacuum chamber 5, the high velocity flow cause turbulent flow, and thus the pressure in the vacuum chamber 5 is not constant but oscillates. Therefore, if the pressure in the vacuum chamber oscillates, the coating of the base film is unstable and thus the quality of a product is poor.

Accordingly, a slot die coating apparatus which can fundamentally solve this problem urgently needs to be developed.

The following patent documents 1 and 2 disclose slot die coating apparatuses.

PRIOR ART DOCUMENTS

Patent Documents

Patent document 1: Korean Unexamined Patent application publication No. 2012-0108484.

Patent document 2: Korean Unexamined Patent application publication No. 2011-0098578.

DISCLOSURE

Technical Problem

The present application is directed to providing a slot die coating apparatus, and more particularly, to providing a slot die coating apparatus which can ensure the coating stability of a base film by effectively reducing pressure oscillations within a vacuum chamber.

Technical Solution

The present application relates to a slot die coating apparatus.

FIG. 2 is a configuration diagram schematically illustrating a slot die coating apparatus according to the present application. The present application will be described below in detail with reference to FIG. 2.

In an exemplary embodiment, the slot die coating apparatus may include: a slot die 14 configured to supply a coating liquid to a base film 12; a vacuum chamber 20 installed at a front end of the slot die 14, and having a gap D formed between the vacuum chamber 20 and the base film 12; and a pressure oscillation reducing tank 30 connected to the vacuum chamber 20.

Like FIG. 2, the base film 12 may be supplied while it is wound around a roll 10.

There is no particular restriction on the material of the base film as long as a coating layer can be formed on the substrate film by the coating liquid. For example, it may be an acryl film or a plastic film which is generally used as an pressure-sensitive adhesive film or an optical film.

The slot die 14 may be arranged adjacent to the roll 10. The slot die 14 may supply the coating liquid to a surface of the base film 12 and may form a coating layer 16 having various patterns on the base film 12.

The vacuum chamber 20 may be installed at the front end of the slot die 14. The vacuum chamber 20 is a device which is installed to increase coating stability on the substrate film 12 by providing the slot die with a vacuum environment when the slot die 14 is coated.

There is no particular restriction regarding the internal pressure of the vacuum chamber 20 as long as the internal pressure of the vacuum chamber 20 is appropriately kept below atmospheric pressure and the amplitude of pressure oscillation due to the introduction of air is 100 Pa or less.

The relation between the volume of the vacuum chamber 20 and the volume of the pressure oscillation reducing tank 30, which will be discussed later, may satisfy the following Formula 1.

$$V_1 \leq V_2. \qquad \text{[Formula 1]}$$

In Formula 1, $V_1$ represents a volume of the vacuum chamber and $V_2$ represents a volume of the pressure oscillation reducing tank.

There is no particular restriction regarding the volume $V_1$ of the vacuum chamber as long as the above Formula 1 is satisfied. For example, the volume $V_1$ of the vacuum chamber may be 0.1 $m^3$ or more, 0.2 $m^3$ or more, 0.3 $m^3$ or more, 0.4 $m^3$ or more or 0.5 $m^3$ or more. There is no particular restriction regarding an upper limit of the volume of the vacuum chamber 20 as long as the volume of the vacuum chamber 20 is smaller than the volume of the pressure oscillation reducing tank 30 which will be discussed later, for example, it may be approximately 0.9 $m^3$, 0.8 $m^3$ or 0.7 $m^3$.

A gap D may be formed between the vacuum chamber 20 and the substrate film 12. Due to this, air which flows into the vacuum chamber 20 may occur turbulent flow. Such a disturbance occurring in the vacuum chamber 20 results in pressure oscillations due to the small volume of the vacuum chamber 20. Thus, if the volume of the vacuum chamber 20 is large, the amplitude of the pressure oscillation with respect to the disturbance of the same magnitude may be small. However, if the volume of the vacuum chamber 20 is more than the aforementioned range, some mechanical problems will occur. Accordingly, the present application intends to solve this problem by installation of a pressure oscillation reducing tank 30 having a larger volume than the vacuum chamber 20 separately from the vacuum chamber 20.

A first pipe 22 is connected to the bottom of the vacuum chamber 20. A pressure gauge 24 is fitted at a side of the first pipe 22 to check the internal pressure of the vacuum chamber 20. An end of the first pipe 22 is connected to a vacuum pump, and thus the internal pressure of the vacuum chamber 20 can be adjusted.

The pressure oscillation reducing tank 30 may be connected to the vacuum chamber 20.

In an exemplary embodiment, as long as the pressure oscillation reducing tank 30 is connect to the vacuum chamber 20 and configured to be able to provide a vacuum environment to the slot die 14 together with the vacuum chamber 20, those who have ordinary knowledge in the art to which the present application pertains can make a variety of modifications and variations within the scope of the present application described in the appended claims.

In an exemplary embodiment, the pressure oscillation reducing tank 30 may be connected to a second pipe 26 which is connected to a side of the first pipe 22. Although FIG. 2 shows that the pressure oscillation reducing tank 30 is connected to the second pipe 26, the present application is not necessarily limited to this embodiment. The second pipe 26 connected with the pressure oscillation reducing tank 30 may be connected to the vacuum chamber 20 directly at a different side from the side at which the first pipe 22 is connected, as shown in FIG. 3.

Like this, if the pressure oscillation reducing tank 30 is directly connected to the first pipe 22 or to the vacuum chamber 20 through the second pipe 26, the effect that the volume of the vacuum chamber 20 is substantially increased can be obtained. If the volume of the vacuum chamber 20 is increased, the pressure oscillation can be remarkably reduced, and thus disturbances can be minimized and the coating stability can be ensured.

The volume of the pressure oscillation reducing tank 30 should be larger than that of the vacuum chamber 20 in order to reduce effectively the pressure oscillation in the slot die coating apparatus including the pressure oscillation reducing tank 30 according to the present application. For example, the volume of the pressure oscillation reducing tank 30 may be 10 times or more, 15 times or more or 20 times or more the volume of the vacuum chamber 20, but the present application is not limited thereto.

In an exemplary embodiment, the volumes of the vacuum chamber and the pressure oscillation reducing tank may satisfy the following Formula 2.

$$V_1+V_2 \geq A(P_2-P_1)DW \quad \text{[Formula 2]}$$

In Formula 2, $V_1$ represents the volume ($m^3$) of the vacuum chamber, $V_2$ represents the volume ($m^3$) of the pressure oscillation reducing tank, A is 1 to 20 $m^3/N$, $P_1$ represents the internal pressure ($N/m^2$) of the vacuum chamber, $P_2$ is atmospheric pressure ($N/m^2$), D is the width (m) of the gap formed at the vacuum chamber, and W represents the horizontal length (m) of the coating layer which is formed after the substrate film is coated.

Also, in the above Formula 2, the units of the volume $V_1$ of the vacuum chamber and the volume $V_2$ of the pressure oscillation reducing tank may be $cm^3$ instead of $m^3$, but are preferably $m^3$. There is no particular restriction regarding a lower limit of the pressure $P_1$ of the vacuum chamber as long as the pressure $P_1$ of the vacuum chamber is lower than atmospheric pressure, for example, it may be 10,000 Pa or less, 5,000 Pa or less, 2,500 Pa or less, 1,000 Pa or less or 900 Pa or less, and may be formed appropriately in the range of approximately 100 Pa to 1,000 Pa.

Also, in the above Formula 2, D represents the width of the gap formed at the vacuum chamber. As the width D is smaller, less air flows into the vacuum chamber, and thus there is no particular restriction regarding the lower limit of the width D, but for example, it may be 1 mm or less, 0.5 mm or less or 0.1 mm or less, and may preferably be formed in the range of approximately 0.1 mm to 0.5 mm. W represents the horizontal length of the coating layer after the base film is coated, and the length W can be varied according to the width of the gap. For example, the length W may be formed in the range of approximately 1 mm to 10,000 mm. A is a constant introduced to represent the sum of the volume $V_1$ of the vacuum chamber and the volume $V_2$ of the pressure oscillating reduction tank proportionally to the product of the difference between the aforementioned atmospheric pressure $P_2$ and the pressure $P_1$ in the vacuum chamber and the width of the gap and the horizontal length of the coating layer, and so as to display the unit appropriately. The unit of A may be expressed in $m^3/N$ or $cm^3/N$. When the unit of A is $m^3/N$, A may be an appropriate value in the range of 0.1 to 30, 0.5 to 25, 0.5 to 20 or 1 to 20.

There is no particular restriction regarding the volume of the pressure oscillation reducing tank 30 as long as the volume of the pressure oscillation reducing tank 30 satisfies the above Formula 2 and is larger than the volume of the vacuum chamber 20, for example, the volume of the pressure oscillation reducing tank 30 may be 1 $m^3$ or more, 1.2 $m^3$ or more, 1.5 $m^3$ or more, 2.0 $m^3$ or more or preferably 2.5 $m^3$ or more. There is no particular restriction regarding an upper limit of the volume of the pressure oscillation reducing tank 30, but for example, it may be approximately 10 $m^3$, 7.5 $m^3$ or 5 $m^3$.

As discussed above, the pressure oscillation in the vacuum chamber can be reduced effectively by connecting the pressure oscillation reducing tank to the vacuum chamber. Thus the coating stability on the substrate film can be ensured, and the defect rate of products can be reduced as a result.

Also, the present application relates to a film on which a coating layer is formed by the above slot die coating apparatus. There is no particular restriction regarding the film as long as the film can be coated and manufactured with the coating layer by the slot die coating method, and for example, it may be a pressure-sensitive adhesive film or an optical film.

Since the film having a coating layer formed by the above slot die coating apparatus has a uniform coating layer formed thereon, the defect rate can be reduced in products to which these films are applied, and thus productivity can be raised as a result.

Advantageous Effects

The slot die coating apparatus according to the present application can effectively reduce the pressure oscillation in the vacuum chamber with the pressure oscillation reducing tank connected to the vacuum chamber. Thus the coating stability on the substrate film can be ensured, and the defect rate of products can be reduced as a result.

DESCRIPTION OF REFERENCE NUMBERS OF MAJOR ELEMENTS

Figure 1:
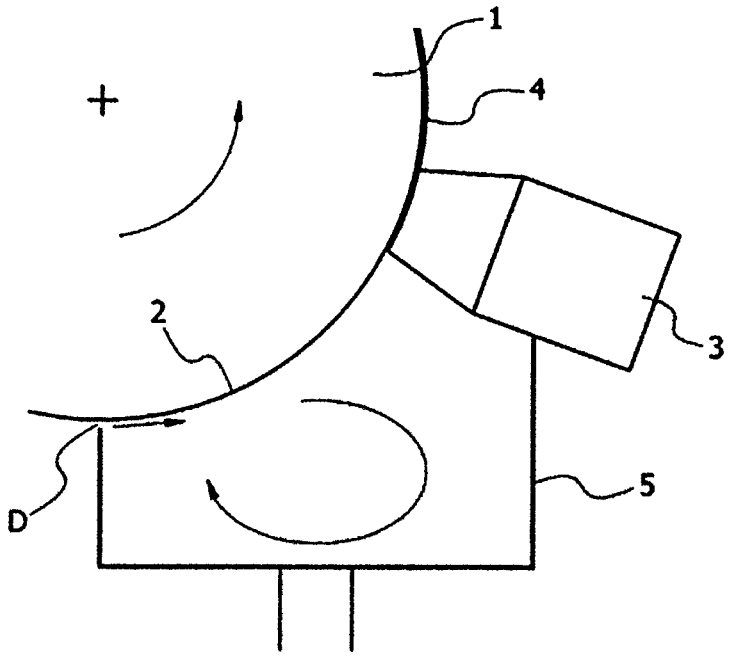
FIG. 1 is a configuration diagram schematically illustrating a slot die coating apparatus according to conventional art.

10: roll
12: base film
14: slot die
16: coating layer
20: vacuum chamber
22: first pipe
24: pressure gauge
26: second pipe
30: pressure oscillation reducing tank

BEST MODE OF THE INVENTION

Hereinafter, the present application will be described in detail through a comparison between Example in accordance with the present application and Comparative example not in accordance with the present application. However, the present application is not limited to Example disclosed below.

Example

Figure 2:
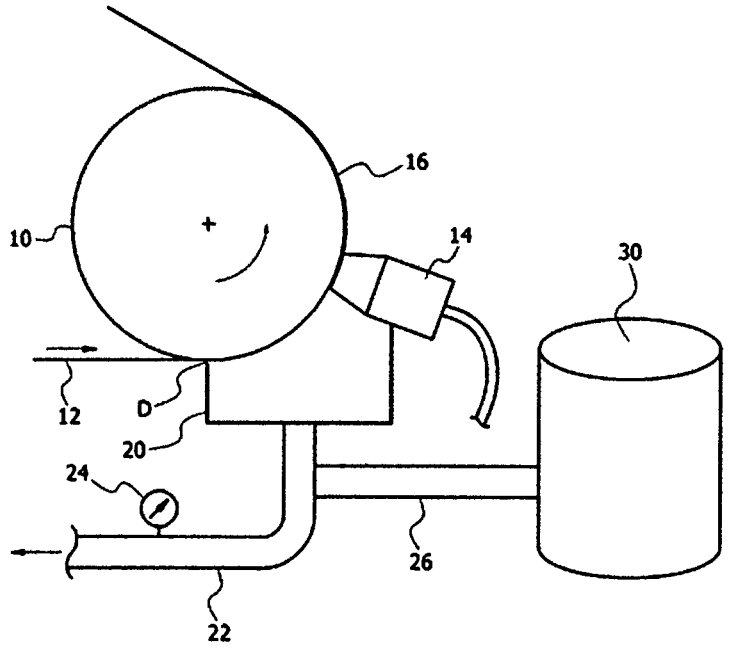
FIG. 2 is a configuration diagram schematically illustrating a slot die coating apparatus according to an exemplary embodiment of the present application.
Figure 3:
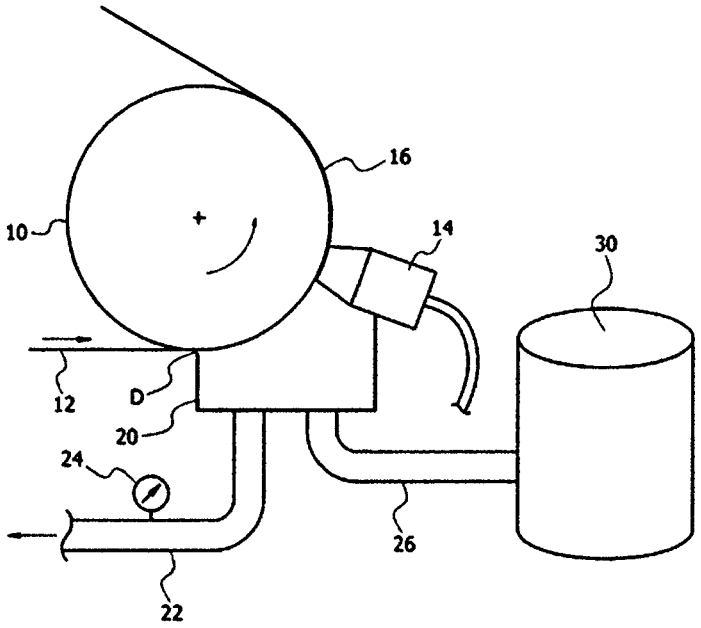
FIG. 3 is a configuration diagram schematically illustrating a slot die coating apparatus according to another exemplary embodiment of the present application.

Using the slot die coating apparatus having a structure according to FIG. 2, with a gap of 0.1 mm, a volume of the vacuum chamber of 0.14 $m^3$ and a volume of the pressure oscillation reducing tank of 0.14 $m^3$, a coating layer was formed on one surface of the based film made of an acryl film using a coating liquid in which a solvent was toluene and a solute was acrylate.

Comparative Example

A coating layer was formed under the same conditions as in the above Example except that a slot die coating apparatus having the structure according to FIG. 1 in which, unlike the slot die coating apparatus used in the above Example, the pressure oscillating tank was not connected to the vacuum chamber.

The coating layers of the above Example and Comparative example were evaluated on the following basis by observing unevenness of the coating layers with the naked eye.

<Evaluation Basis>

O: Unevenness of coating layer on the surface of the acryl film is not checked by the naked eye.

X: Unevenness of coating layer on the surface of the acryl film is remarkably observed by the naked eye.

The results of observation of the above Example and Comparative example are given in the following table 1.

TABLE 1

| | Example | Comparative example |
|---|---|---|
| Degree of unevenness of coating | O | X |

As shown in table 1, it can be verified that the slot die coating apparatus according to the present application can effectively reduce the pressure oscillation in the vacuum chamber by connecting the pressure oscillation reducing tank to the vacuum chamber, and thus ensure the coating stability on the substrate film and reduce the defect rate of products.

The invention claimed is:

1. A slot die coating apparatus comprising:

a slot die configured to supply a coating liquid to a base film;

a vacuum chamber configured to hold a gas volume $V_1$ and installed at a front end of the slot die and having a gap formed between the vacuum chamber and the base film;

a first pipe connected to a vacuum pump and connected to the vacuum chamber;

a pressure oscillation reducing tank configured to hold a gas volume $V_2$; and a second pipe connected to the pressure oscillation reducing tank and to the first pipe, or connected to the pressure oscillation reducing tank and to the vacuum chamber;

wherein $V_1 \leq V_2$ and together the vacuum chamber and the pressure oscillation reducing tank are configured to provide a vacuum environment to the slot die and which satisfies the following Formula 2:

$$V1+V2 \geq A(P2-P1)DW \quad \text{[Formula 2]}$$

wherein V1 represents a volume (m3) of the vacuum chamber, V2 represents a volume (m3) of the pressure oscillation reducing tank, A is 1 m3/N to 20 m3/N, P1 represents a pressure (N/m2) in the vacuum chamber, P2 represents atmospheric pressure (N/m2), D represents a width (m) of the gap formed at the vacuum chamber, and W represents a horizontal length (m) of a coating layer which is formed after the substrate film is coated.

2. The slot die coating apparatus of claim 1, further comprising a roll around which the base film is supplied to the slot die.

3. The slot die coating apparatus of claim 1, wherein the volume of the pressure oscillation reducing tank $V_2$ is two times or more the volume of the vacuum chamber $V_1$.

4. The slot die coating apparatus of claim 1, wherein the volume of the pressure oscillation reducing tank $V_2$ is 10 times or more the volume of the vacuum chamber $V_1$.

5. The slot die coating apparatus of claim 1, wherein the volume of the pressure oscillation reducing tank $V_2$ is 20 times or more the volume of the vacuum chamber $V_1$.

* * * * *